US006318060B1

(12) United States Patent
Dinkelmann et al.

(10) Patent No.: US 6,318,060 B1
(45) Date of Patent: Nov. 20, 2001

(54) METHOD AND SPINNING MACHINE FOR THE PRODUCTION OF CORE YARN

(75) Inventors: Friedrich Dinkelmann, Rechberghausen; Andreas Olbrich, Kirchheim, both of (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/445,259

(22) PCT Filed: Mar. 31, 1999

(86) PCT No.: PCT/DE99/01050

§ 371 Date: Mar. 13, 2000

§ 102(e) Date: Mar. 13, 2000

(87) PCT Pub. No.: WO99/51801

PCT Pub. Date: Oct. 14, 1999

(30) Foreign Application Priority Data

Apr. 3, 1998 (DE) ..... 198 15 054

(51) Int. Cl.[7] ..... D02G 03/36
(52) U.S. Cl. ..... 57/3; 57/75; 57/328; 19/244
(58) Field of Search ..... 57/3, 75, 328; 19/244

(56) References Cited

U.S. PATENT DOCUMENTS

| | | | | |
|---|---|---|---|---|
| 4,584,830 | * | 4/1986 | Faure et al. | 57/328 |
| 5,600,872 | * | 2/1997 | Artzt et al. | 19/244 |
| 5,651,244 | * | 7/1997 | Lucca et al. | 57/75 |

FOREIGN PATENT DOCUMENTS

| | | | |
|---|---|---|---|
| 39 00 197 A1 | | 7/1990 | (DE) . |
| 4426249-A1 | * | 1/1996 | (DE) . |
| 195 01 163 C1 | | 4/1996 | (DE) . |
| 196 01 466 A1 | | 7/1997 | (DE) . |
| 0635590-A2 | * | 1/1995 | (EP) . |
| 2 583 784 | | 12/1986 | (FR) . |
| WO 84/04550 | | 11/1984 | (WO) . |
| WO 98/39505 | | 9/1998 | (WO) . |

* cited by examiner

*Primary Examiner*—John J. Calvert
*Assistant Examiner*—Shaun R Hurley
(74) *Attorney, Agent, or Firm*—Herbert Dubno

(57) ABSTRACT

A method and device for the production of core yarn (63), whereby a core yarn (12) is brought to a fiber slubbing (8) which has been refined in a drafting system before said slubbing is reinforced by twisting. The core yarn (12) is embedded in covering fibers. The fiber slubbing is compressed in a compacting device (22) after the core yarn (12) has been brought to the slubbing and before twisting occurs.

10 Claims, 7 Drawing Sheets

METHOD AND SPINNING MACHINE FOR THE PRODUCTION OF CORE YARN

Figure 1:
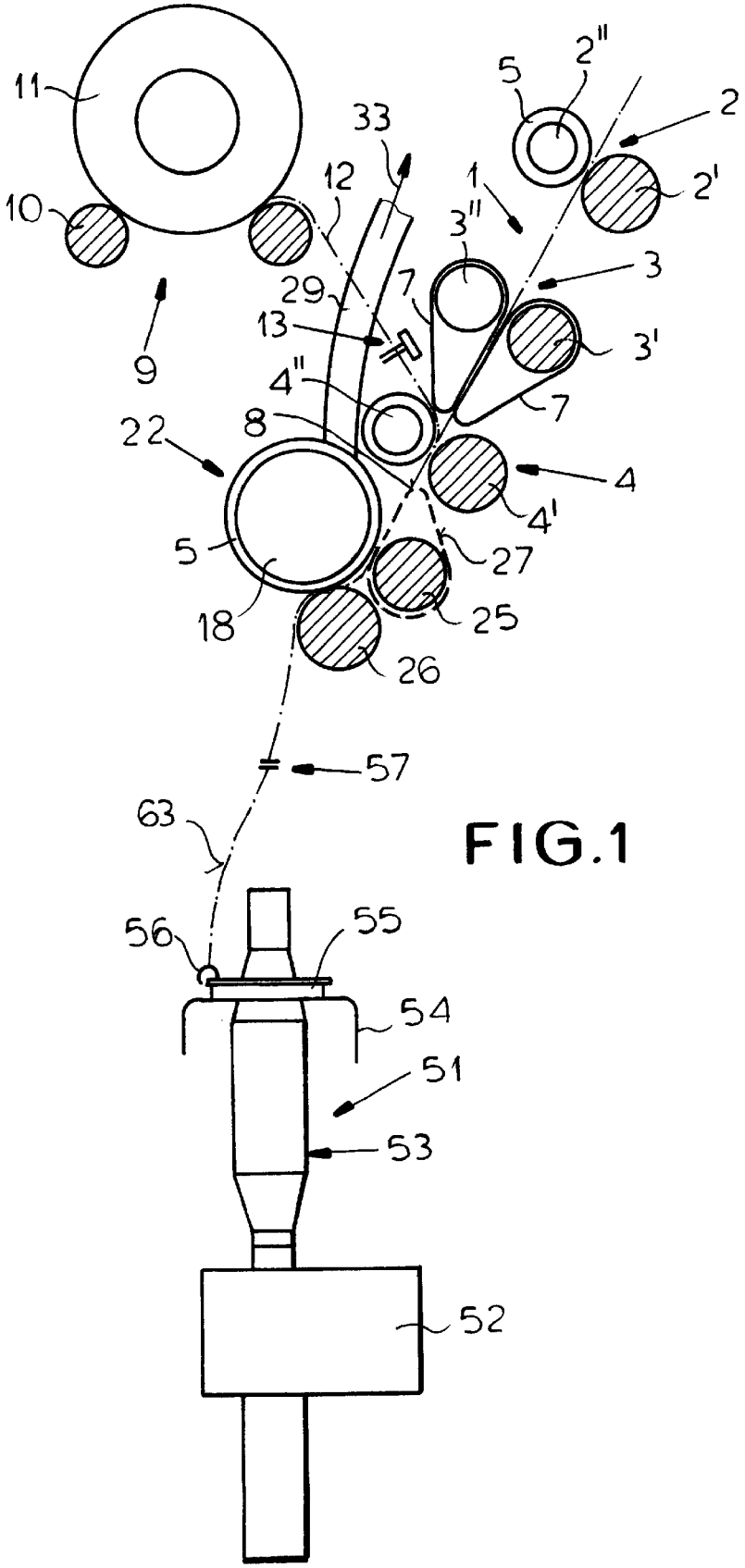

The invention relates to a method for producing core yarn in which a sliver (fiber slubbing) is refined in a drafting frame before it is stabilized by twisting and then fed to a core yarn which is embedded in covering fibers. The invention relates further to a spinning machine for producing core yarns and having a drafting frame which supplies a fiber slubbing, with a device for feeding the core yarn and a device for twisting and winding up the core yarn.

The production of core yarn is characterized in that in the formation of the yarn and especially upon its drafting to a predetermined fineness and its stabilization by twisting, a core thread is laid into the fiber slubbing and has cover fibers spun around it so that the core thread in the best case is no longer visible. The core thread determines thereby substantially the strength and elongation of the generated yarn while cover fibers above all determine the hand and visual appearance of the yarn. The core threads as a rule are endless synthetic threads while the cover fibers are usually natural staple fibers like cotton and wool.

In a core yarn it is intended that the core thread be embedded as completely as possible in the cover fiber which determines the external appearance. In normal core yarn spinning, this is achieved in that the core thread is fed into the fiber slubbing as a rule in the last and thus the main drafting field while the cover fibers are laid around the core thread by the twisting of the fiber band between the output roller pair [of the drafting frame] and the element from which the twist arises, as a rule a ring spinning spindle. This embedding is effected rather incompletely at numerous locations along the yarn which results in a reduction in quality of the generated core yarn.

It is the object of the invention to improve this embedding of the core thread in the cover fiber. This is achieved by features given in the corresponding clause of the main claim. With these features, the embedding of the core yarn in the cover fibers is supported by a compaction in addition to a twisting so that, in effect, there are fewer gaps and over the length of the yarn a more uniform covering of the core thread by the cover fibers.

The arrangement can be so made that the fiber slubbing supplied by the drafting frame or in the case of a plurality of fiber slubbings supplied by the drafting frame at least one of these fiber slubbings before the output from the main drafting field or at the input to the compaction zone is met by a core thread, the core thread and fiber slubbing being compacted together, and finally subjected to twisting to form the core yarn. A plurality, especially two fiber slubbings are supplied by the drafting frame in the case of production of false twist.

An apparatus for carrying out this process has at the output of a drafting frame a compaction device maintained under suction which is formed with a perforation row, i.e. a row running in the direction of movement of the fiber slubbing of small suction orifices toward which the fibers of the fiber slubbing are sucked. Compaction devices in the form of rotating cylindrical rollers having a perforation row (DE 44 28 269 A1) or in the form of an endless flexible belt provided with a perforation row (EP 0 635 590 A2) are known.

An especially effective embedding of the core thread can be achieved when, according to the invention, the compaction zone is located as close as possible to the center of the fiber slubbing which is still wide upon its approach to the compaction zone. This is especially the case when the core thread is fed to the inlet side of the output roller pair of the drafting frame.

In a variation of this embodiment, the core thread can also be fed directly to the compaction zone. In the case of a suction belt compaction device, the core thread can be fed from above or from below to the drafting frame, from the same side as that along which the suction belt is disposed and can be guided around the deflection end of the belt at its upstream side. In other cases, the suction belt has a guide roller arranged at its upstream or inlet side around which the core thread is guided. When the compaction device has a suction roller, the core thread also can be fed to the periphery of this suction roller.

The compaction of fiber slubbing supplied by a drafting frame affords the advantage that the fiber slubbing is gathered tightly upon entry to the twisting zone upon which it is stabilized to a yarn. In this tightly gathered fiber slubbing, the twisting imparted to the yarn jumps practically to the clamping line at which the fiber slubbing with the core yarn emerges, i.e. the spinning triangle is very small. A consequence is that the losses of edge fibers which break away are minimal and that the yarn which is produced has few projecting fibers, i.e. reduced hairiness and as a consequence more effective coverage of the core thread by the fibers lying tightly thereagainst.

It has been found that this advantageous effect of compaction spinning can be further increased by carrying out the spinning in a thread-balloonless manner or with a reduced thread balloon. Thread-balloonless spinning or spinning with a reduced thread balloon, reduces the tension forces on the yarn in the yarn segment between the apex of the spindle and the output roller pair of the drafting frame and increases the twist density in this yarn segment. This effect appears to enhance the effect of compaction of the fiber slubbing.

The balloonless spinning or reduced thread balloon spinning can be achieved especially by providing an attachment on the spinning spindle of the ring spinning apparatus in the form of a spinning finger or a spinning crown. The twisting and winding up of the fiber slubbing by means of pot spinning apparatus also is effected without balloon formation and reduces the yarn tension forces in the yarn segment between the output roller pair of the drafting frame and the point at which the yarn meets the spinning pot. This system also has the advantages previously described of balloonless spinning.

The Figures of the drawing show embodiments of the invention. The illustration is largely schematic and not to scale.

It shows

Figure 2:
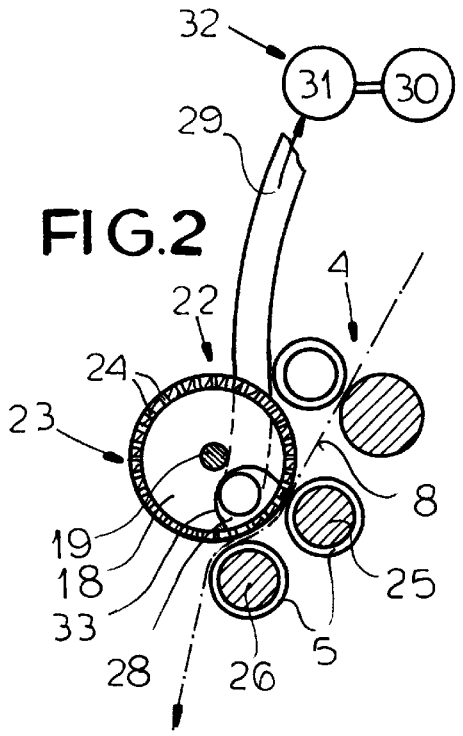
Figure 3:
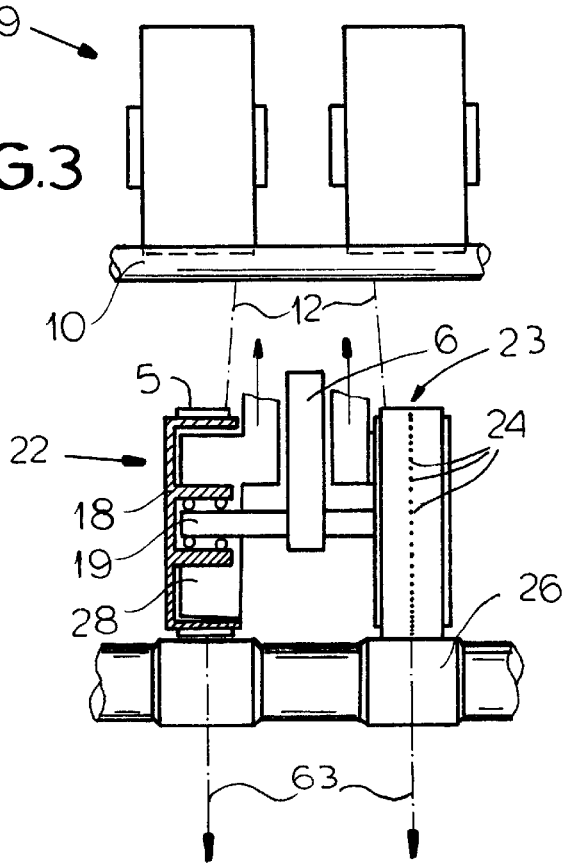
Figure 8:
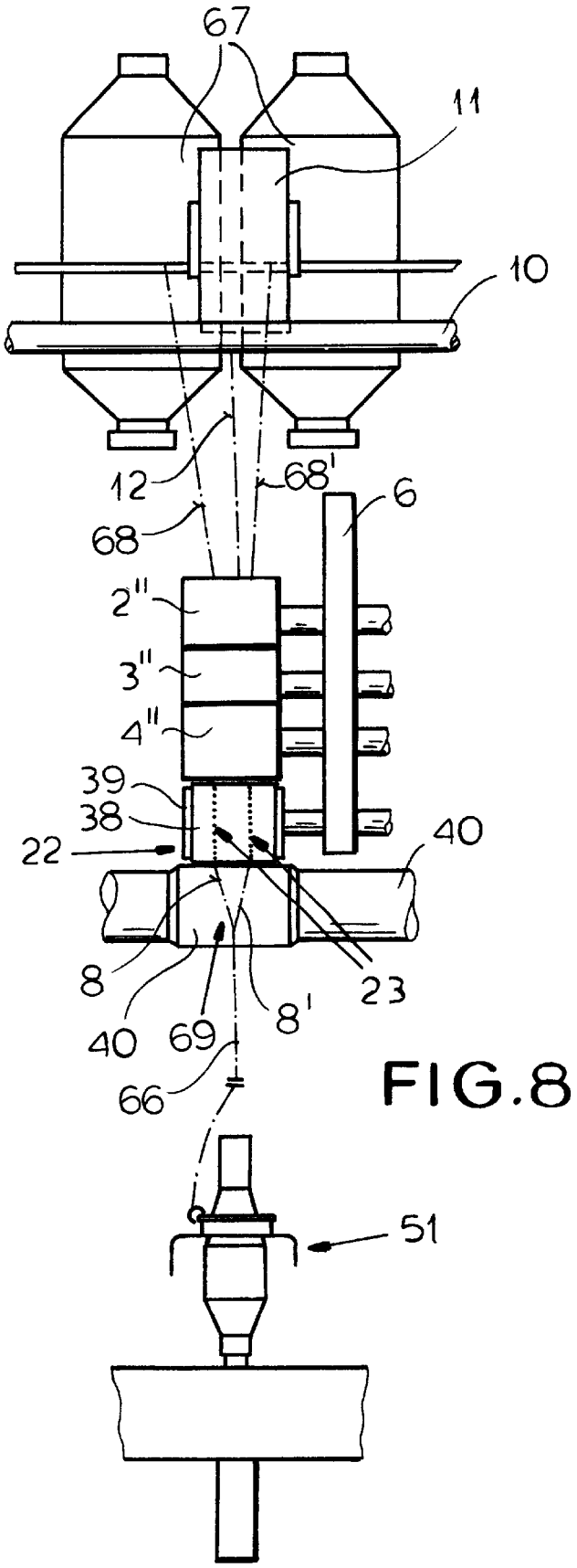

FIG. 1 a first embodiment of the invention in section through the drafting frame region and through the spindle rows;

FIG. 2 a second embodiment of the drafting device illustrated in FIG. 1, partly in section;

FIG. 3 an elevation of the drafting device of FIG. 1 partly cut away;

FIGS. 4 to 7 further embodiments of the invention in illustrations as in FIG. 1;

FIG. 8 an embodiment for production of false twist as seen in front elevation.

The spinning machine of the invention comprises a drafting frame 1 of conventional construction with an input roller pair 2, an intermediate roller pair and an output roller pair 4. The lower rollers 2', 3' and 4' of these roller pairs are configured as steel rollers which extend over the length of the drafting frame region of the spinning machine and have milling in the vicinities of the work stations.

The upper rollers 2", 3" and 4" are configured as twin rollers which are provided with elastic jackets 5 and are journaled on a support and loading arm 6 indicated in FIGS. 3 and 8 by means of articulations not shown, and are spring-loaded. The rollers 2' and 2" [sic] of the intermediate roller pair 2 [sic] are equipped with belts 7 which are guided also in the support and loading arm 6 or on the stand of the drafting frame 1 in journaled belt cages. The drafting frame 1 supplies a strip-like not yet compacted fiber slubbing which has been stretched to the final fineness and has been indicated at 8. It will be self-understood that the invention is also effective in combination with drafting frames of other types.

The drafting frame 1 is, according to the invention, juxtaposed with a core thread supply mechanism 9 which in the embodiments of FIGS. 1–3 and 5–8 has supply reel rollers 10 which also extend over the length of the drafting frame region of the spinning machine. On the supply reel rollers 10 rest a core thread spool 11 from which the core thread 12 is fed as illustrated in the drawing in a double-dot dash line [sic] to the input side of the output roller pair 4. The reel rollers 10 are driven via the spinning machine drive in a manner not shown here in greater detail with the peripheral speed of the supply roller pair 4. In this manner it is ensured that the core thread 12 which is fed to the fiber slubbing 8 will have a safety corresponding to the discharge speed of the fiber slubbing from the main drafting field between the roller pairs 3 and 4.

The core thread supply mechanism 9 is provided with a core thread thread guide 13 which neutralizes the back and forth (traversing) movement of the core thread along the core thread spool 11. Since the capacity of the compaction device to be described hereinafter to laterally draw the fiber slubbing 8 or its fibers together, the fiber slubbing is provided with a conventional roving inlet funnel 14 to center it on the drafting frame 1 to prevent the traversing or permitting it to fluctuate only slightly in its outer dimensions. So that the core thread 12 is always fed centrally to the fiber slubbing 8, the core thread thread guide 13 must be centered to the roving inlet funnel 14 of the drafting frame 1 and this position must be maintained even upon fluctuation of the fiber slubbing. This can be ensured by mechanically coupling the roving inlet funnel and the core thread thread guide 13 which has been indicated by a effective dot-dash line 15 in FIG. 4.

It is, however, also possible to utilize a core thread thread guide which is free shiftably laterally and with which the fiber slubbing running through the drafting frame is entrained, to center the core thread 12 to the fiber slubbing or follows a slubbing in its back and forth (traversing) movement.

Figure 7:
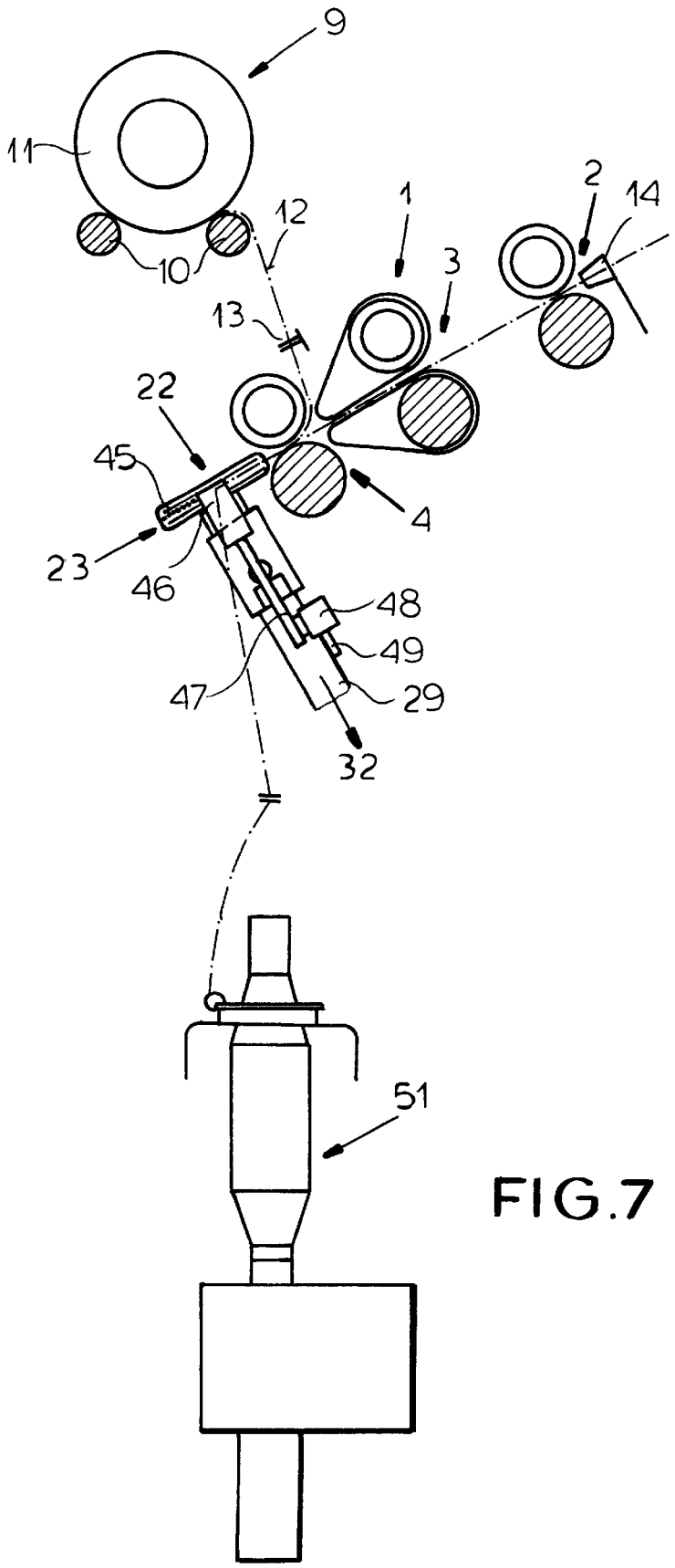

The suction rotor of FIG. 7 can also compact side fiber slubbings 8 which are moving back and forth (traversing) widely so that with its use, both the fiber slubbing by means of the common roving inlet funnel 14 at the inlet of the drafting frame 1 and also the core thread 12 by means of the core thread thread guide 13, synchronized with the roving inlet funnel 14, can move back and forth (traverse) over a wide range.

Figure 4:
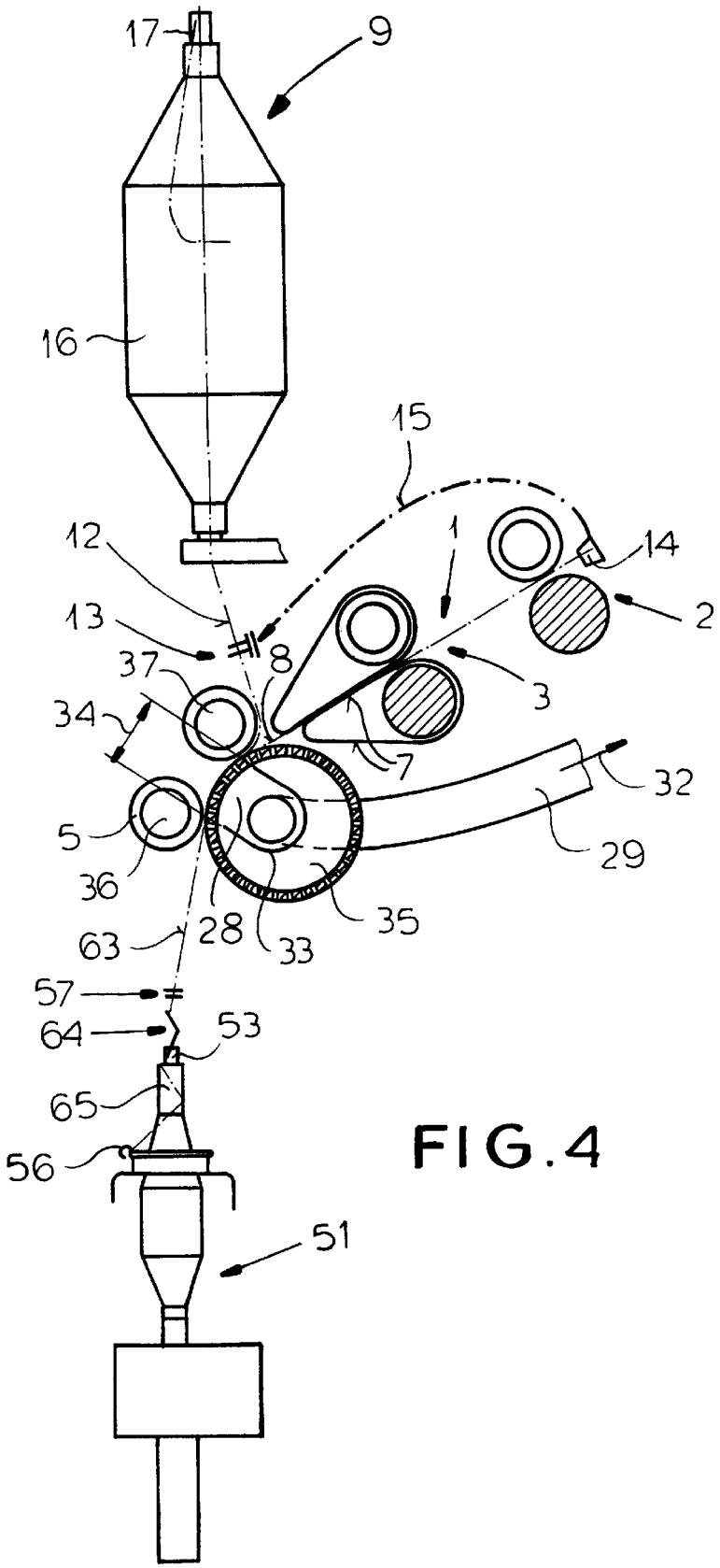

As has been shown in FIG. 4, the core thread 12 can also be drawn off from a stationary core thread cop 16 from above. The core thread cop 16 for this purpose is fitted over a holding tube 37 and the core thread passes through this holding tube. Since, in the embodiment of this FIG. 4, the function of the output roller pair of the drafting frame 1 is replaced by the suction roller 18 to be described in greater detail later, in combination with the upper roller 37 juxtaposed therewith, the core thread 12 in this case is fed to this upper roller and is drawn from the core thread cop by the said effect of this roller combination.

Figure 6:
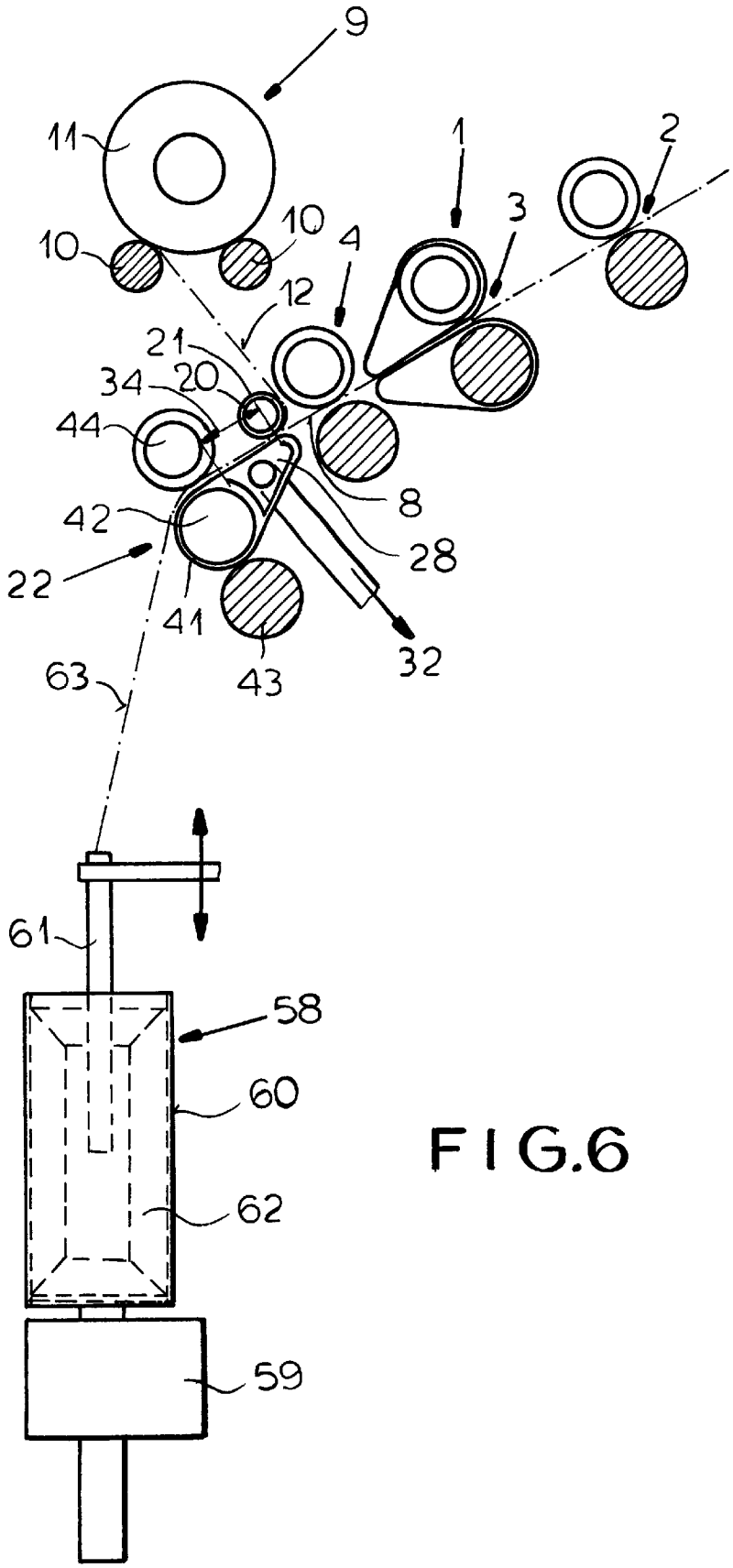

As shown in FIG. 6, instead of the core thread guide 13, a core thread guide roller 20 with a central thread guide groove 21 is provided. This core thread guide roller 20 can be journalled in the support and loading arm 6 of the drafting frame. Since it does not move back and forth (traverse), with its use a back and forth (traversing) movement of the fiber slubbing 8 is not possible.

The drafting frame 1 is followed by a compaction device 22 for the fiber slubbing 8 supplied by the drafting frame 1. For the compaction device, an entire range of advantageous embodiments is possible and from which several are illustrated in the Figure of the drawing and are described hereafter.

In the embodiment of FIGS. 1 through 3, the compaction device has a suction roller 18 which is formed with a perforation 23 in the form of small suction orifices 24 arranged in a line. The suction rollers 18 are configured as twin upper rollers and are pressed against two lower rollers 25 and 26 by the support and loading arm 6 indicated in FIG. 3. The lower roller 25 which is located upstream with respect to the travel direction of the fiber slubbing 8 is looped by a transport belt 27 which has the purpose of guiding the fiber slubbing 8 between the output roller pair 4 and the suction roller 18.

FIG. 3 also shows the configuration of this suction roller 18. It is configured of cup shape and is journalled with its twin roller on an axle 19 held in the support and loading arm 6. A stationary suction chamber 28 extends through the open side into the interior of the suction roller 18. The suction chamber 28 is, like in the variants described below of the compaction device 22, as shown in FIG. 1, connected via a tube or hose line 29 with a suction source 32 comprising a suction pump 31 and a motor 30. The suction draw of this suction source is restricted by the shield 33 of the suction chamber 28 to a part of the perforation of the suction roller 18 corresponding to a compaction zone 34 only in this compaction zone 34 is the suction chamber 28 open to the perforation 34 so that only there will the suction be effective through the perforation at the outer side of the suction roller 18.

The suction roller 18 is comprised as a rule from steel. To avoid a metallic contact between its circumference and under rollers 25 and 26 which as a rule are also composed of steel, leading to wear, noise and slip, either the suction roller 18 or the lower rollers 25, 26 are provided with elastic jackets 5. In the alternative shown in FIGS. 1 and 3, the suction roller 18 is provided with the elastic jacket 5 while in the embodiment of FIG. 2 the support rollers 25 and 26 are provided with elastic jackets. FIG. 4 shows an embodiment in which a suction roller similar to that previously described is used in the form of a suction lower roller 35. It is configured as a tube provided with the perforation 23 which is journalled in the stand of the drafting frame 1 and is driven.

In its interior, the suction chamber 28 is arranged, this suction chamber having its suction effect limited by a shield 33 to a compaction zone 34. Suction lower roller 35 has at least one upper roller 36 juxtaposed therewith and forming a twist stop for a twist generating device, here in the form of a ring spinning device. At the beginning of the compaction zone 34, a further upper roller 37 can be arranged. This upper roller 37 forms, in this embodiment of the drafting frame 1, in combination with the suction (lower) roller 35, the output roller pair of the main drafting vehicle of the drafting frame. The drafting frame 1, in this case has one roller pair fewer than the other embodiments. The upper rollers 36 and 37 have elastic jackets 5 and are journalled and loaded in the support and loading arm 6.

Figure 5:
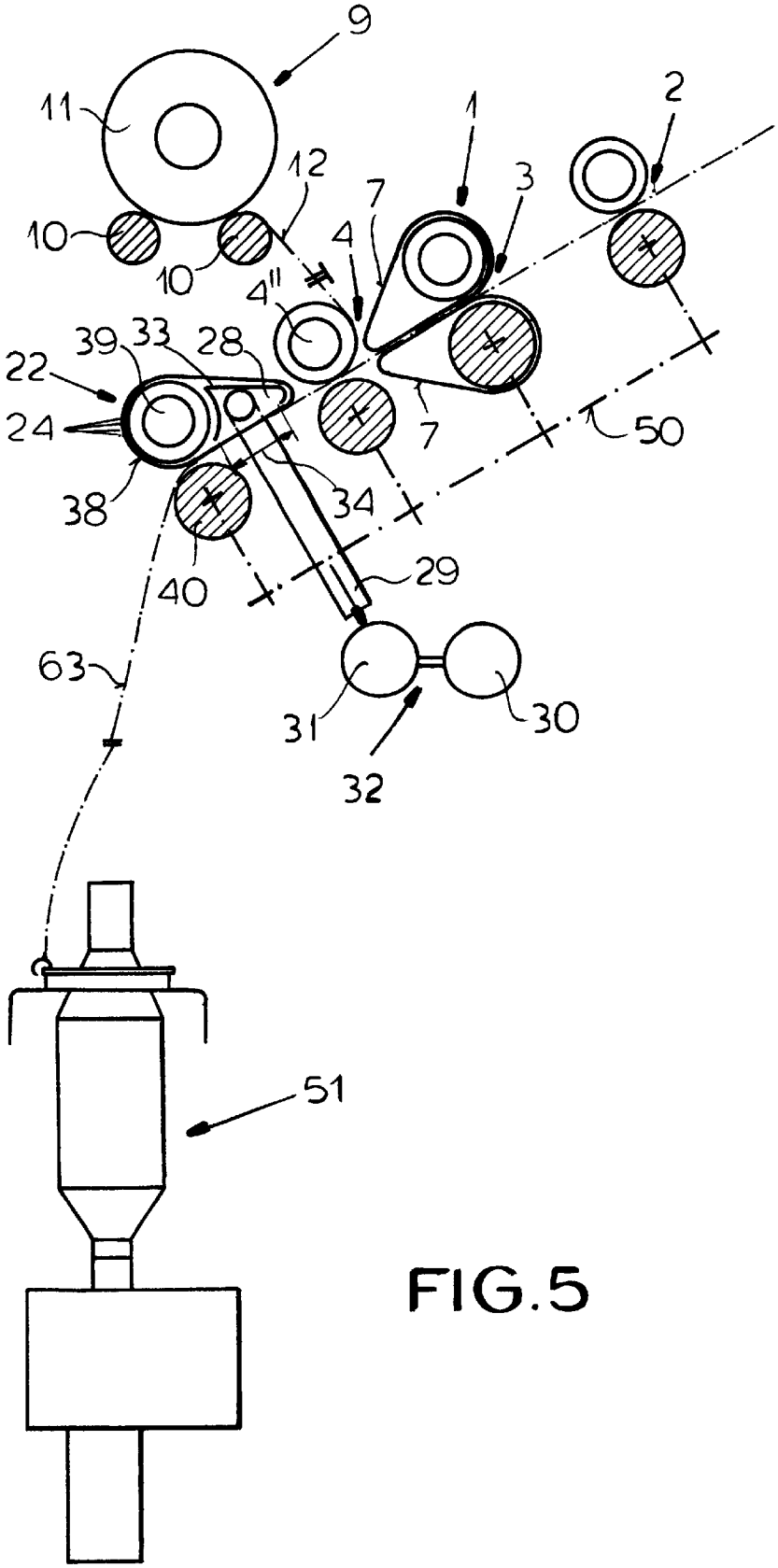

In the embodiment of FIG. 5, the compaction device 22 has a suction belt 38 which is composed of elastic synthetic resin and is looped around an upper roller 39. This suction belt 38 has midway of its periphery the perforation 23 in the form of small suction orifices arrayed in a row. In this embodiment as well, the fixed suction chamber 28 is bounded by the shield 23 which defines the suction chamber within the interior of the suction belt 39. It limits the suction effect to the compaction zone 34 in which the suction chamber opens along the inner periphery of the suction belt 38.

The upper rollers 39 rest with their belts 38 on a driven lower roller 40 which, like the lower rollers of the drafting frame, extending over the length of the stretch field region of the spinning machine and drive the upper rollers and the suction belts. In the embodiment of FIG. 6, the roller below the path of the fiber slubbing 8 and thus the stretching field plane, looped by a suction belt 41 equivalent to that described, is formed as an under roller 42. It rests upon a drive under roller 43 which is configured as a continuous steel roller extending over the stretch field region of the spinning machine and serves to drive the belt roller 42 and an upper roller 44 juxtaposed therewith and lying above the stretch field plane.

Within this suction belt 42, also as has been previously described, a suction chamber 28 connected to the suction source 32 is arranged.

Both the suction belt lower roller 42 and the upper roller 44 are formed as twin rollers and are held on and loaded by the support and loading arm 6 of the drafting frame 1. The pressure upper roller 44 can have an elastic jacket or, since it rests upon the suction belt 41 of elastic synthetic resin material, can have a steel circumference. The use of a separate belt twin under roller has the advantage that the suction belts 41 can be more easily replaced upon wear.

The compaction device, can, according to FIG. 7 also have a disk shaped suction rotor 45 which has the perforation 23 along its periphery and which is so arranged that the perforated-containing plane lies generally in the plane tangential to the output roller pair 4 at the drafting frame at its nip. The suction chamber 28 defining the compaction zone is provided within the interior of the suction rotor 45. The compaction zone 34 extends from the output roller pair 4 by the example, a quarter of the periphery of the suction rotor and at its end, a pressing roller 46 is spring biased against the suction rotor 45. The suction rotor 45 is, for example, driven by means of an endless circulating an tangential drive belt 29 acting via a pressing roller 48 against the shaft 47 connected thereto. The suction rotor 45 is driven with a speed which corresponds to the supply speed of the fiber slubbing produced by the output roller pair 4. The lower rollers 2', 3', 4' of the drafting frame 1 and the lower rollers 25, 26, 35, 40 and 43 of the various variants of the compaction device 22 are, as represented by the dot dash line 50 in FIG. 1, driven by means of a drive not shown or by means of individual drives on speed ratios which are staggered from one to another.

In the embodiments of FIGS. 1, 2, 3, 5, 6 and 8, the lower rollers 25, 26, 40 or 42 from which the fiber slubbing 8 is delivered and from which the twist is generated, have a diameter which is selected as advantageous for the process of the respective staple fiber. This diameter amounts for example in the case of cotton to 29 mm to 33 mm. The compaction device 22 is followed in the embodiments of FIGS. 1, 4 and 5 as well as 7 and 8 by a conventional ring spinning device 51 with a spindle rail 52, spinning spindles 53, ring rail 54, spinning ring 55, travellers 56 and thread guide 57. FIG. 6 shows an embodiment in which the compaction device 22 is followed by a conventional pot spinning device 58 with a pot rail 59 in which a spinning pot 60 is journalled and in the middle of which and around an upwardly and downwardly moving thread guide tube 61, a spun cake 62 is formed.

In operation, the drafting frame 1 supplies a fiber slubbing 8 from the output roller pair 4 which, as a consequence of the diameter of the incoming roving and the drafting processing has a certain width into which the core thread 12 is centrally laid in. By the suction draw of one of the aforedescribed compaction devices 22, the fibers of the fiber slubbing 8 are drawn laterally to a narrow line along the suction openings 24 of the respective compaction device, thereby compacting the fiber slubbing 8 and causing the fibers to densely hug the core thread 12. In this compacted state, the fiber slubbing 8 and the core thread 12 encased therein are fed from the nip defined by the compaction device to the ring spinning device 51 or the pot spinning device 58 from which a twist is produced to stabilize a core yarn 63 and enable that core yarn to be wound up. FIG. 4 shows the use of a ring spinning device 51 without a thread balloon or with a reduced thread balloon. At the apex of the spinning spindle 53 for this purpose a so-called spinning finger 64 is disposed which, in coaction with the thread guide 57 captures the oncoming core yarn and loops it around the yarn sleeve 65 and guides it without a thread balloon or with a very small reduced thread balloon to the traveller 56. Instead of the spinning finger 64, an equivalently operating spinning crown can be used as is known and thus not further described here or illustrated.

Finally, in FIG. 8, the possibility has been illustrated of a compaction device 22, for example, that of FIG. 5, for the production of false twists. For this purpose, the suction belt 38 has a perforation 23 in the form of two mutually spaced rows of suction orifices 24 by means of which fiber slubbings 8, 8' are separately compacted as supplied from respective working stations from two roving bobbins 67 and are described in drafting frame 1. After the compacted fiber slubbings pass from the lower roller 40 of the compaction device 22, the two fiber slubbings run together at the uniting point 68 and are twisted to a false twist 66 by a ring spinning device 51 or by a pot spinning device 58 the false twist being wound up.

In producing the false twist 66, two fiber slubbings 8, 8' are joined. As a rule, it is sufficient for productions of core yarn false twist to feed a core thread to only one of the fiber slubbings 8. In FIG. 8 only one core thread thread spool 11 is shown whose core thread 12 is fed to the right hand fiber slubbing 8.

It will be self understood that the described and illustrated variants of the components of the spinning machine of the invention, for example the drafting frame 1, the compaction device 22, the twisting and wind up device 50 or 58 and the optional devices for balloonless spinning by means of spinning finger 64 and the device for production of the false twist can be used in other combinations than those illustrated and described effectively.

REFERENCE NUMERAL LIST

1 Drafting Frame
2 Input roll pair
3 Intermediate roll pair

4 Output roll pair
2', 3', 4' Lower rollers
2", 3", 4" Upper rollers
5 Elastic jacket
6 Support and Loading Arm
7 Belts
8, 8" Fiber Slubbing
9 Core Thread Supply Mechanism
10 Delivery Roll
11 Core Thread Spool
12 Core Thread
13 Core Thread Thread Guide
14 Roving Feed Funnel
15 Effective Line
16 Core Thread Cop
17 Holder Tube
18 Suction Roller (FIGS. 1 through 3)
19 Upper Roller
20 Core Thread Guide Roller
21 Thread Guide Groove
22 Compaction Device
23 Perforation
24 Suction Orifices
25, 26 Lower Roller
27 Transport Belt
28 Suction Chamber
29 Tube or Hose Line
30 Motor
31 Suction Pump
32 Suction Source
33 Shield
34 Compaction Zone
35 Suction Roller (FIG. 4)
36, 37 Upper Rollers
38 Suction Belts (FIG. 5)
39 Upper Rollers
40 Lower Rollers
41 Suction Belt (FIG. 6)
42 Lower Rollers
43 Drive lower rollers
44 Upper Rollers
45 Suction Rotor
46 Pressing Roller
47 Shaft
48 Pressing Roller
49 Tangential Drive Belt
50 Effective Line
51 Ring Spinning Device
52 Spindle Rail
53 Spinning Spindle
54 Ring Rail
55 Spinning Ring
56 Traveller
57 Thread Guide
58 Pot Spinning Device
59 Pot Rail
60 Spinning Pot
61 Thread Guide Tube
62 Spinning Core
63 Core Yarn
64 Spinning Finger
65 Yarn Sleeve
66 False Twist
67 Roving Bobbin
68 Joining Point

What is claimed is:

1. A spinning machine for producing a core yarn, comprising:

a drafting frame having a plurality of roller pairs traversed in succession by a fiber slubbing and subjecting said fiber slubbing to drafting during passage through said drafting frame, said drafting frame having at an output thereof a compaction device, said compaction device comprising a driven endless surface formed with a perforation extending around a periphery of said compaction device, a suction source connected to said perforation to apply suction therethrough to said slubbing, thereby drawing fibers of said slubbing together, and at least one roller juxtaposed with said surface whereby said slubbing passes between said roller and said surface;

a core thread supply for feeding a core thread into said slubbing centrally of said perforation and directly on said surface whereby said core thread is enveloped in said slubbing; and a spinning frame downstream of said drafting frame and receiving the slubbing with the core thread enveloped therein for spinning the slubbing and the core thread enveloped therein into a core yarn.

2. The spinning machine defined in claim 1 wherein said roller is a guide roller positioned to guide said core thread onto said surface.

3. The spinning machine defined in claim 1 wherein said perforation is a row of orifices formed in said surface and said section source includes an element within said compaction device restricting the application of suction to a limited number of said orifices in a compaction zone.

4. The spinning machine defined in claim 3 wherein said surface is formed by a belt.

5. The spinning machine defined in claim 3 wherein said surface is formed by a roller.

6. The spinning machine as defined in claim 3 wherein said roller is provided above said surface.

7. The spinning machine as defined in claim 3 wherein said roller is provided below said surface.

8. The spinning machine as defined in claim 3 wherein said perforation comprises two rows of orifices.

9. The spinning machine as defined in claim 3 wherein said spinning frame is a ring spinning frame.

10. The spinning machine as defined in claim 3 wherein said spinning frame is a pot spinning frame.

* * * * *